US010188258B2

(12) United States Patent
Deveau

(10) Patent No.: US 10,188,258 B2
(45) Date of Patent: Jan. 29, 2019

(54) MULTI-FUNCTION CLEANING TOOL

(71) Applicant: James Deveau, North York (CA)

(72) Inventor: James Deveau, North York (CA)

( * ) Notice: Subject to any disclaimer, the term of this patent is extended or adjusted under 35 U.S.C. 154(b) by 461 days.

(21) Appl. No.: 15/192,374

(22) Filed: Jun. 24, 2016

(65) Prior Publication Data

US 2017/0007092 A1 Jan. 12, 2017

Related U.S. Application Data

(60) Provisional application No. 62/188,924, filed on Jul. 6, 2015, provisional application No. 62/305,579, filed on Mar. 9, 2016.

(51) Int. Cl.

| | |
|---|---|
| ***A47L 13/12*** | (2006.01) |
| ***A47L 13/11*** | (2006.01) |
| ***A46B 9/06*** | (2006.01) |
| ***B25G 3/38*** | (2006.01) |
| ***B25G 1/04*** | (2006.01) |

(52) U.S. Cl.

CPC ..... *A47L 13/12* (2013.01); *A46B 9/06* (2013.01); *A47L 13/11* (2013.01); *B25G 1/04* (2013.01); *B25G 3/38* (2013.01); *A46B 2200/302* (2013.01)

(58) Field of Classification Search

CPC . A47L 13/12; A47L 13/11; A46B 9/06; A46B 2200/302; B25G 1/04; B25G 1/06; B25G 1/08; B25G 3/38

USPC ..... 15/105

See application file for complete search history.

(56) References Cited

U.S. PATENT DOCUMENTS

| | | | | |
|---|---|---|---|---|
| 5,810,408 | A * | 9/1998 | Armstrong | A01B 1/00 16/422 |
| 6,669,397 | B1 * | 12/2003 | Christion | B25G 3/00 15/105 |
| 6,990,705 | B1 * | 1/2006 | Schouten | A47L 13/11 15/105 |
| 7,107,644 | B1 * | 9/2006 | Bahl, Jr. | A47L 13/12 15/105 |
| 7,343,637 | B2 * | 3/2008 | Lafleur | A46B 7/04 15/105 |
| 8,984,702 | B2 * | 3/2015 | Pant | A46B 5/0058 15/105 |
| 2002/0078518 | A1 * | 6/2002 | Jiang | A47L 1/06 15/111 |
| 2002/0078519 | A1 * | 6/2002 | Boothby | A47L 1/06 15/121 |
| 2004/0031116 | A1 * | 2/2004 | Coleman | A46B 7/02 15/172 |
| 2004/0250365 | A1 * | 12/2004 | Anderson | A46B 15/0081 15/111 |
| 2007/0101524 | A1 * | 5/2007 | Pfister | A01D 7/00 15/105 |
| 2007/0234497 | A1 * | 10/2007 | Lee | A47L 13/12 15/144.1 |

(Continued)

*Primary Examiner* — Weilun Lo

(74) *Attorney, Agent, or Firm* — Kinney & Lange, P.A.

(57) ABSTRACT

A cleaning tool includes a handle having a longitudinal axis and a cleaning device having a longitudinal axis. The cleaning device is releasably securable to the handle and is moveable between a first position where the longitudinal axis of the cleaning device is generally aligned with the longitudinal axis of said handle, and a second position where the longitudinal axis of the cleaning device is arranged at an angle relative to the longitudinal axis of the handle.

15 Claims, 14 Drawing Sheets

(56) References Cited

U.S. PATENT DOCUMENTS

| | | | | |
|---|---|---|---|---|
| 2008/0072388 | A1* | 3/2008 | Jones | A46B 5/0075 15/105 |
| 2008/0209647 | A1* | 9/2008 | Morgan | A46B 5/005 15/4 |
| 2009/0172903 | A1* | 7/2009 | Vosbikian | A46B 5/0075 15/172 |
| 2011/0308025 | A1* | 12/2011 | Vosbikian | A46B 5/0008 15/105 |
| 2014/0182074 | A1* | 7/2014 | Mark | A47L 13/24 15/105 |

* cited by examiner

MULTI-FUNCTION CLEANING TOOL

FIELD

The present invention relates to cleaning tools and cleaning devices.

BACKGROUND

Brooms are common tools used to clean floors and a wide variety of other surfaces and objects.

Conventional push brooms typically comprise bristles attached to a broom head that is secured or otherwise mounted on a handle. Push brooms are commonly used to brush or push debris on a floor, usually by applying a pushing or pulling force to the broom. In order to facilitate their use, push brooms typically have handles that extend from the broom head at an oblique angle, allowing a user to stand behind the broom head, with the bristles in contact with the floor or surface for easier pushing and pulling.

Where fine dirt or debris is to be swept, traditional upright brooms are often utilized. Upright brooms typically comprise relatively fine, soft, bristles that can at times be more effective than those of push brooms for capturing fine debris. The broom heads of upright brooms are often smaller than the broom heads of push brooms. Upright brooms therefore tend to be more easily maneuvered into corners and tight spaces. Further, the handles of upright brooms tend to extend upwardly from the broom head in a manner that is generally aligned with the bristles. Because the soft bristles are easily bent, users need not stand behind the broom head when using an upright broom. Rather, the broom can be swung in a pendulum-like manner such that the bristles sweep the floor surface. Upright brooms also tend to be simpler to manoeuvre when sweeping debris into a dust pan.

In some cases, there may be a need to remove liquids or semi-solid products (e.g., paint) from a floor or surface. In such cases, brooms may be less effective at removing the product than other cleaning implements, such as squeegees. Where product has hardened and adhered to a surface (e.g., dried paint) a broom will tend to be ineffective in its removal. In those instances, a scraper tool may be used to scrap the material from the surface. Any loosened debris resulting from the scraping action may then be swept with a broom.

It is often desirable to sweep or clean a variety of different types of debris. Typically, when faced with having to sweep or clean many different types of debris (for example, as may occur on a construction site), it is necessary to use a variety of different cleaning tools. In such cases users will often need to switch between tools while cleaning, increasing the time required to clean a site, decreasing worker efficiency, and generally increasing operating and capital costs.

SUMMARY

There is provided a cleaning tool comprising a handle having a longitudinal axis and a broom head having bristles extending therefrom, said bristles having a longitudinal axis and arranged in a generally parallel configuration, said broom head moveable between a first position, where the longitudinal axis of the bristles is arranged at an angle relative to the longitudinal axis of said handle, and a second position, where the longitudinal axis of the bristles is generally aligned with the longitudinal axis of said handle.

There is also provided a cleaning tool comprising an elongate handle having a longitudinal axis, said handle including first and second coupling mechanisms, and a broom head including a third coupling mechanism, said broom head having bristles extending therefrom, said bristles having a longitudinal axis and arranged in a generally parallel configuration; said first and said third coupling mechanisms together operable to releasably secure said broom head to said handle in a first arrangement in which the longitudinal axis of said bristles is arranged at an angle relative to the longitudinal axis of said handle, and said second and said third coupling mechanisms together operable to releasably secure said broom head to said handle in a second arrangement that is different from said first arrangement.

There is further provided a cleaning tool comprising an elongate handle including an upper portion pivotally connected to a lower portion, said lower portion having a longitudinal axis and including first and second coupling mechanisms, a broom head having bristles extending therefrom, said bristles having a longitudinal axis and arranged in a generally parallel configuration; and a cleaning device, said first coupling mechanism operable to releasably secure said broom head to said lower portion of said handle in a first arrangement in which the longitudinal axis of said bristles is at an angle relative to the longitudinal axis of said lower portion of said handle; said second coupling mechanism operable to releasably secure said cleaning device to said lower portion of said handle.

Further aspects of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DESCRIPTION

The present invention may be embodied in a number of different forms. The specification and drawings that follow describe and disclose some of the specific forms of the invention.

Figure 1:
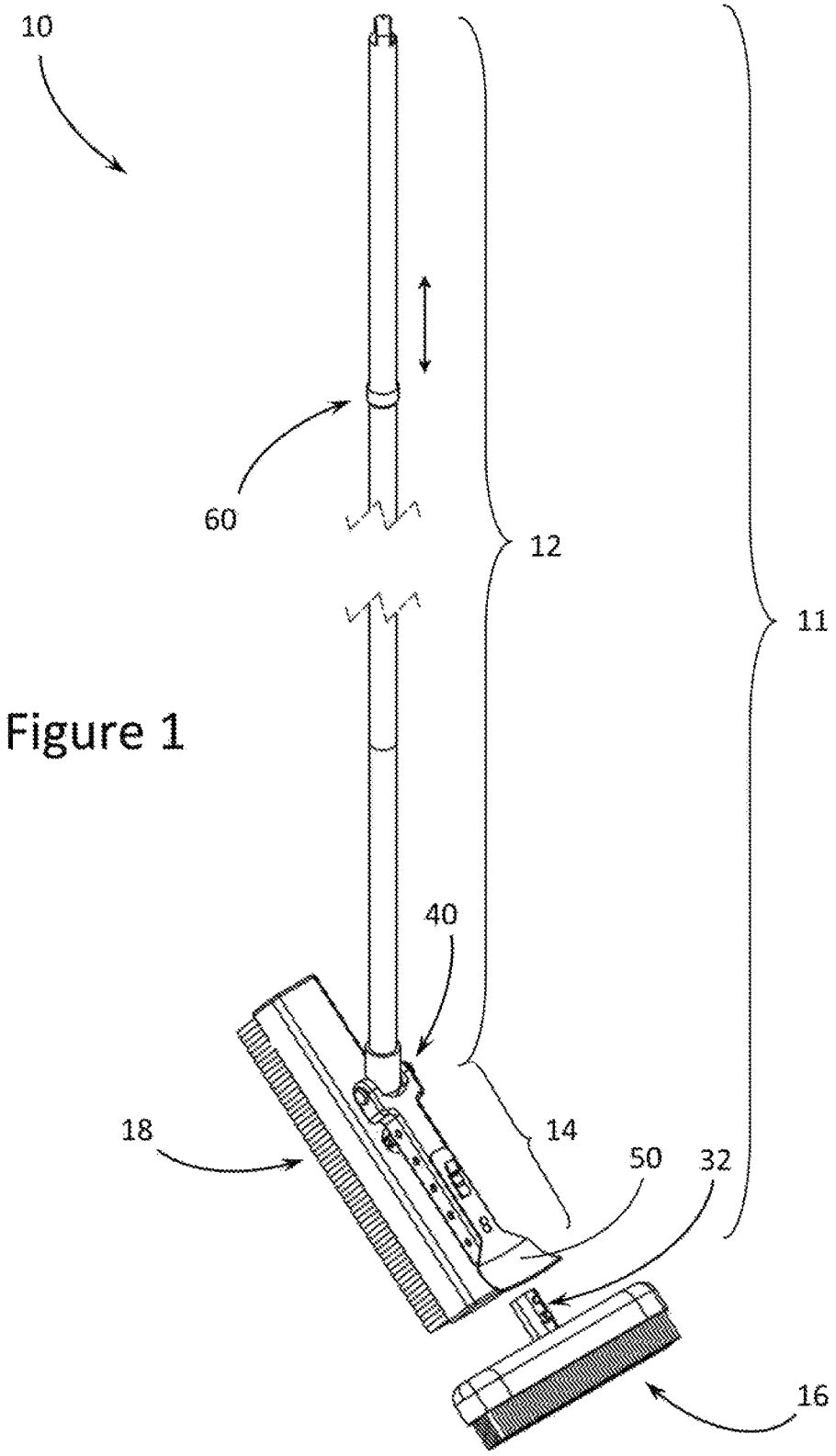
FIG. 1 is a partial exploded perspective view of a cleaning tool according to an example embodiment of the present invention.
Figure 2:
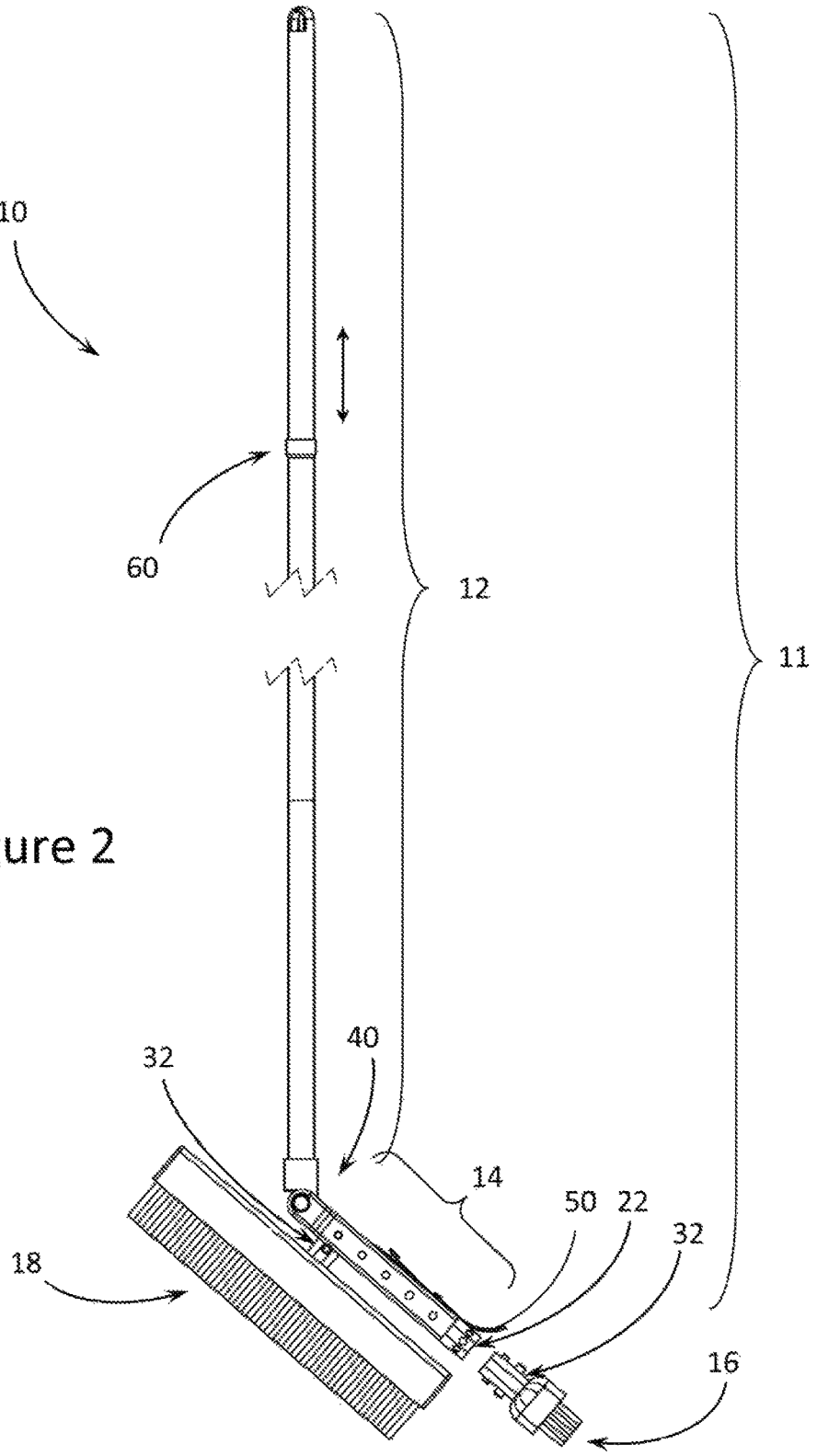
FIG. 2 is a side view of the cleaning tool of FIG. 1.
Figure 3:
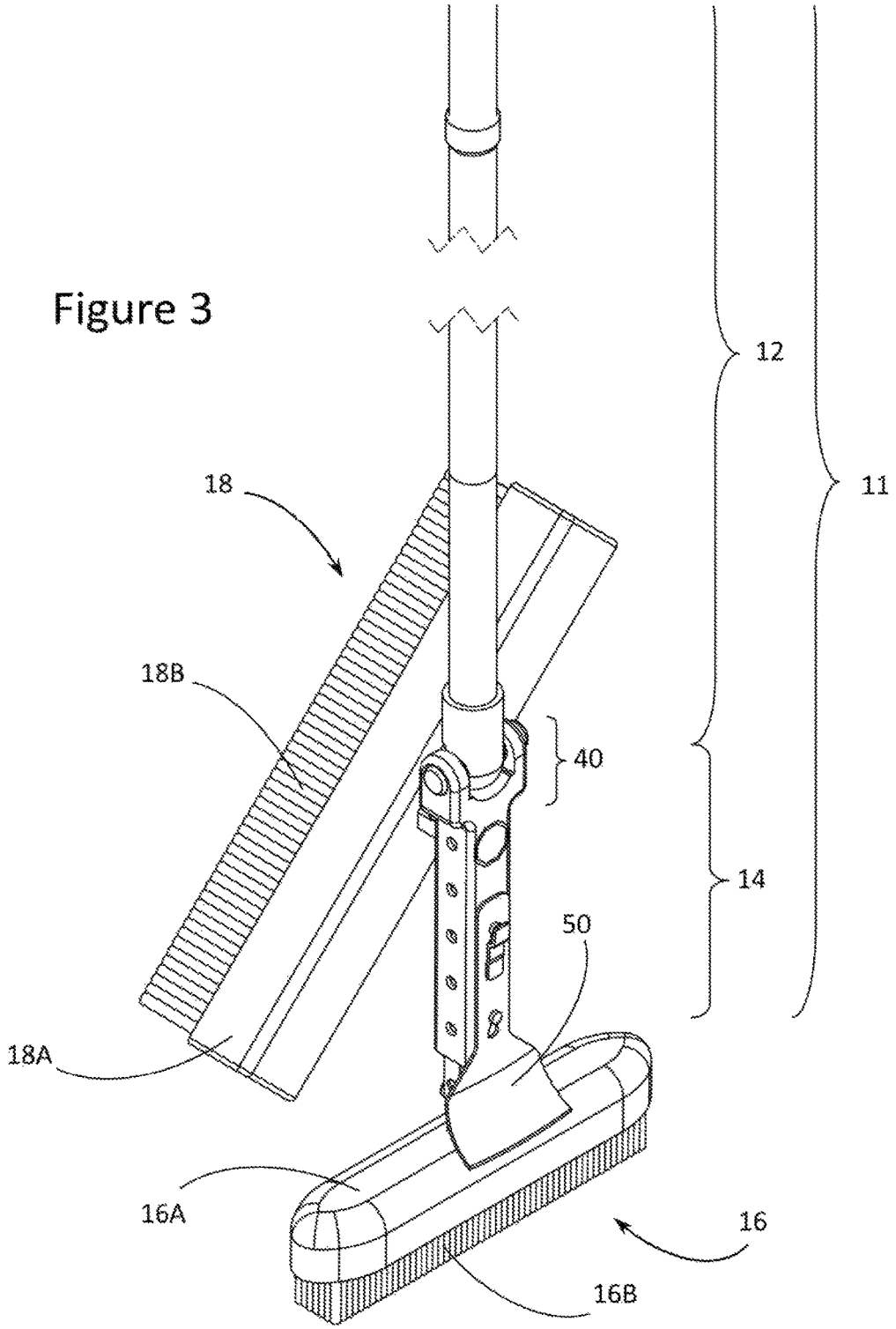
FIG. 3 is an enlarged perspective view of the lower portion of a cleaning tool according to another example embodiment of the present invention.
Figure 4:
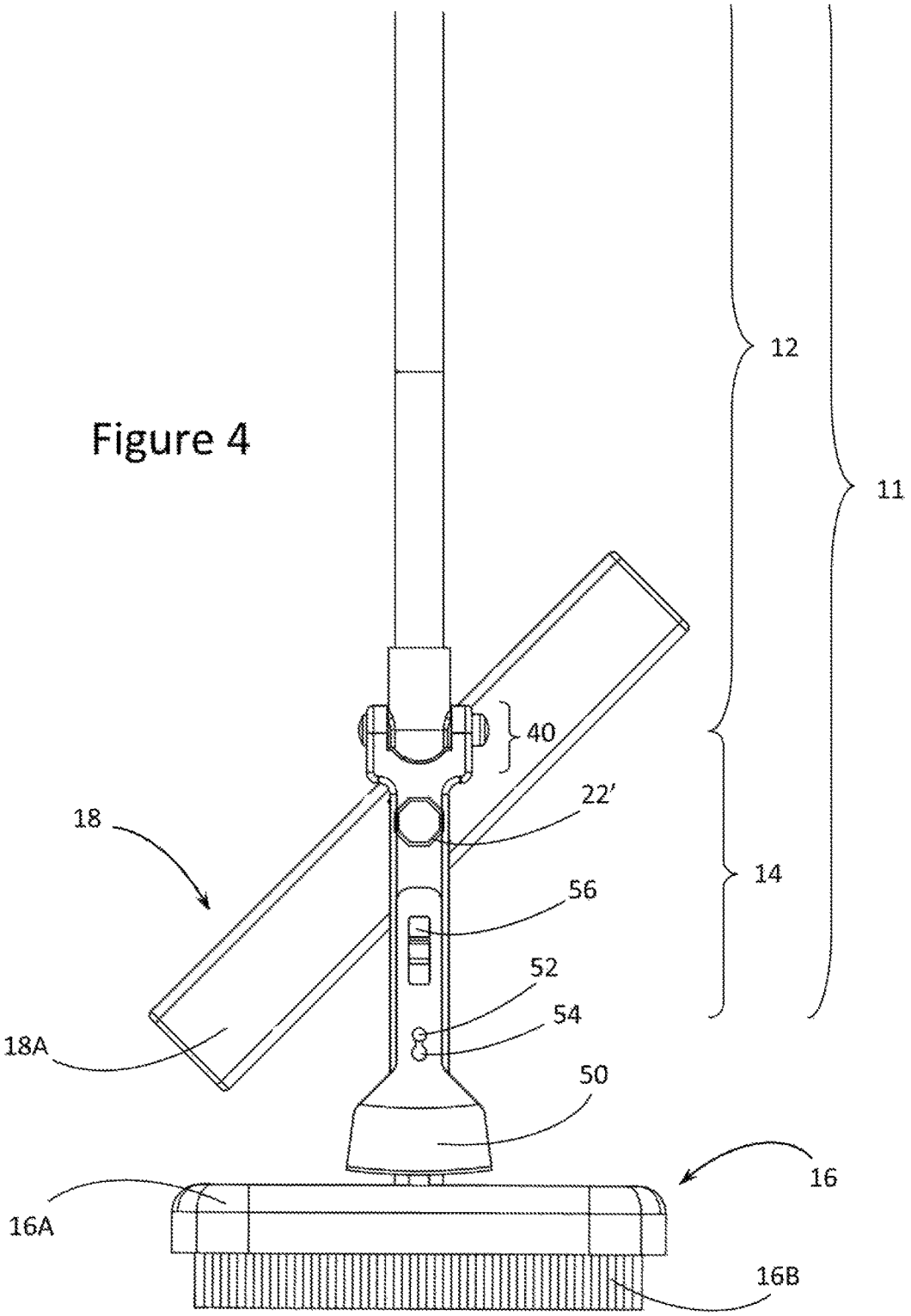
FIG. 4 is a front view of the cleaning tool of FIG. 3.

In the attached drawings, a multi-function cleaning tool constructed in accordance with the present invention is represented generally by reference character 10. As shown in FIGS. 1 and 2, multi-function cleaning tool 10 generally comprises a handle 11 having a longitudinal axis, which preferably comprises of an upper portion 12 and a lower portion 14, pivotally connected by a hinge 40. As also shown in FIGS. 1 and 2, the length of upper portion 12 of handle 11 is optionally adjustable, for example through use of a telescoping bar 60.

Releasably secured to lower portion 14 is at least one cleaning device. The embodiments shown in FIGS. 1-10 demonstrate the use of two cleaning devices (namely, an upright broom 16 and a push broom 18) releasably secured to lower portion 14.

Figure 5:
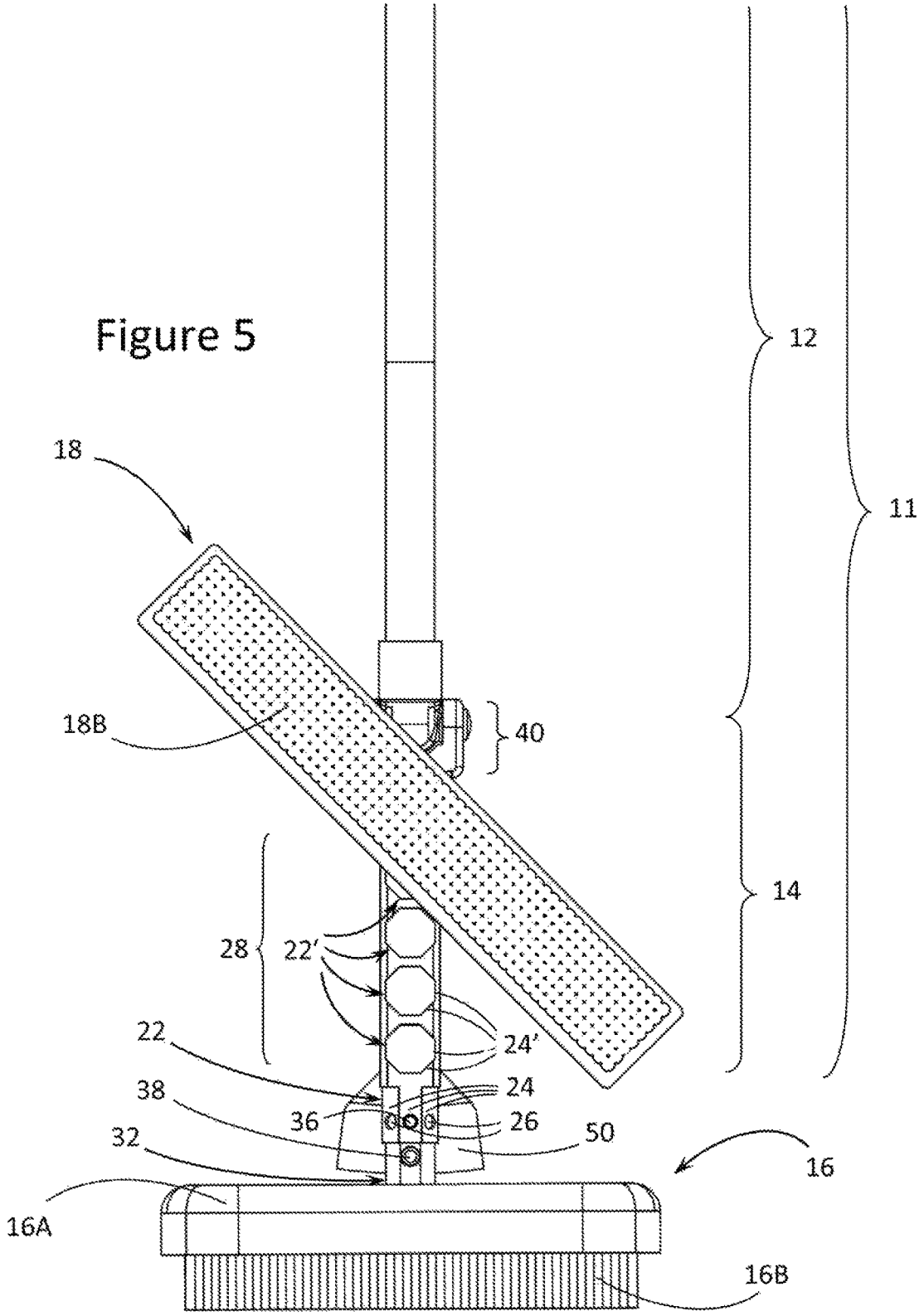
FIG. 5 is a back view of the cleaning tool of FIG. 3.
Figure 7:
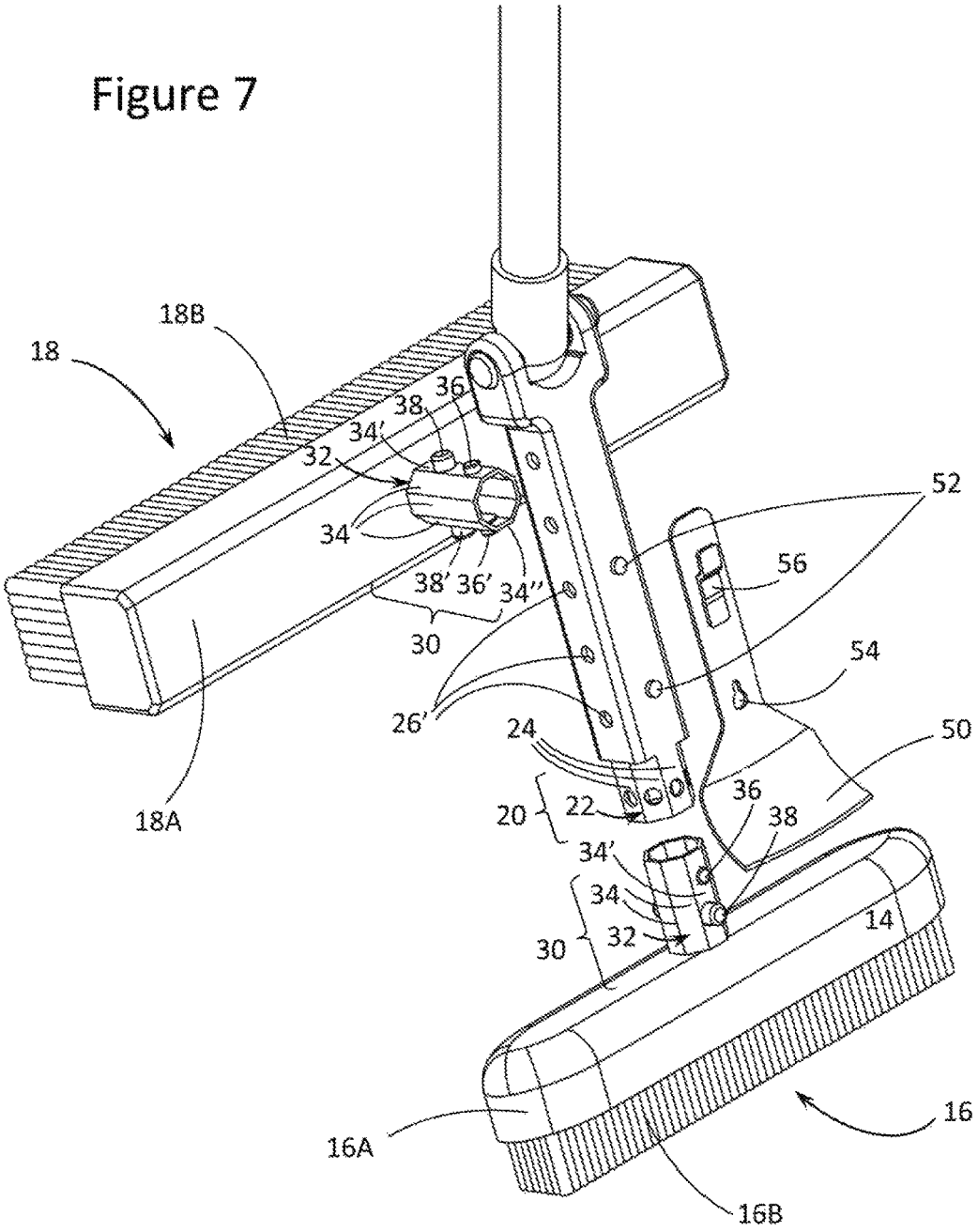
FIG. 7 is an exploded top perspective view of the lower end of an example embodiment of the present invention.

As shown in FIGS. 5 and 7, lower portion 14 has an end (opposite hinge 40) with a first coupling mechanism 20 and a second coupling mechanism 28 fixed to or integral with lower portion 14. In the embodiments depicted in FIGS. 5 and 10, second coupling mechanism 28 is arranged along the longitudinal axis of lower portion 14. Upright broom 16 and push broom 18 each have a third coupling mechanism 30, which connect or cooperate with first coupling mechanism 20 and second coupling mechanism 28 in order to releasably secure upright broom 16 and push broom 18 to lower portion 14.

First coupling mechanism 20 is situated at the end of lower portion 14 opposite hinge 40. In the embodiment depicted in FIG. 7, first coupling mechanism 20 is an octagonal prism shaped receiver 22 composed of sidewalls 24 having an open lower end. Here, second coupling mechanism 28 consists of at least two octagonal prism shaped receivers 22' substantially similar to receivers 22 and arranged along the longitudinal axis of lower portion 14. Each receiver 22' is composed of sidewalls 24' having an open outer end.

In the depicted embodiments, third coupling mechanism 30, is an octagonal prism shaped post 32, geometrically shaped and dimensioned to nest into the first and second coupling mechanisms. In the particular embodiment depicted in FIG. 7, post 32 is composed of sidewalls 34. Post 32 also has at least one, but preferably two, flexibly resilient support arms (not shown) which extend from opposite sidewalls 34' and 34" inside post 32. The support arms retain stoppers 36 and 36' and buttons 38 and 38' which extend through openings in opposite sidewalls 34' and 34". It will be appreciated that the respective flexibly resilient support arms are attached to post 32 such that they are capable of a slight movement or bending into the hollow interior of post 32 when pressure is applied to buttons 38 and 38'.

Figure 6:
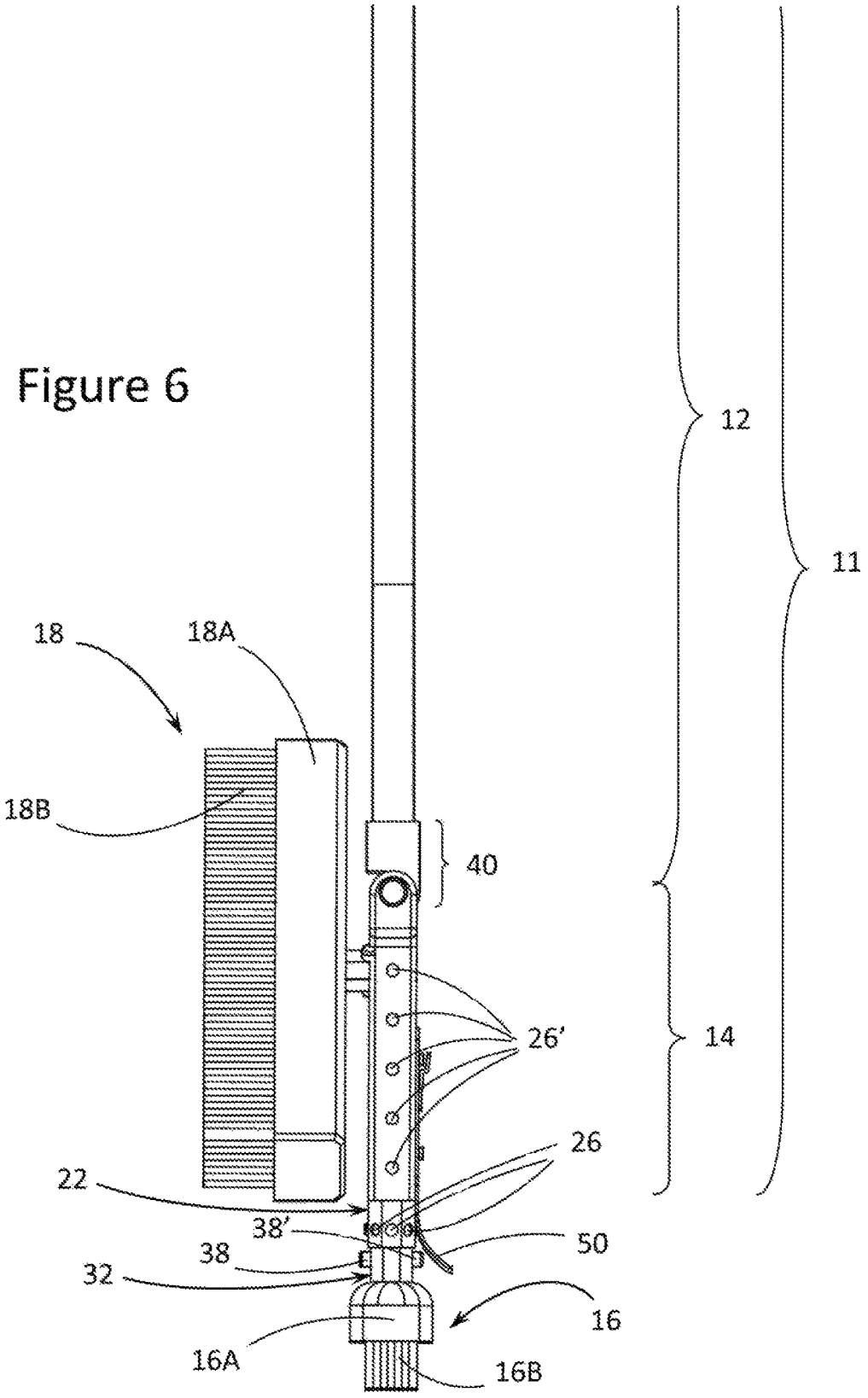
FIG. 6 is a side view of the cleaning tool of FIG. 3.

As shown in FIGS. 5 through 7, side walls 24 include holes 26 and sidewalls 24' include holes 26'. Holes 26 and 26' are formed at an appropriate distance from the open end of receivers 22 and 22' to allow seating of stoppers 36 and 36' within holes 26 and 26'. In this manner, post 32 (and the broom head secured thereto) may be releasably secured to handle 11 through the receipt of post 32 within receiver 22 or 22'. Stoppers 36 and 36', in combination with holes 26 and 26', act as button lock mechanisms which permit the broom head to be releasably secured to the lower portion of handle 11 at discrete angular arrangements.

Upright broom 16 includes an upright broom head 16A, with a front and a rear face, and upright broom bristles 16B extending generally perpendicularly from the front face of upright broom head 16A. Upright broom bristles 16B have a longitudinal axis and are arranged in a generally parallel configuration. Third coupling mechanism 30 is fixed to, or integral with, the rear face of upright broom head 16A and is positioned generally parallel to upright broom bristles 16B.

Buttons 38 and 38' not only permit stoppers 36 and 36' to be withdrawn into post 32, but also are set off longitudinally from the stoppers to permit the stoppers to align with holes 26 and 26' where the buttons contact the end of receiver 22 and 22'.

Push broom 18 may include a push broom head 18A, with a front and a rear face, and push broom bristles 18B extending generally perpendicularly from the front face of push broom head 18A. Push broom bristles 18B have a longitudinal axis and are arranged in a generally parallel configuration. Fixed to, or integral with, the rear face of push broom head 18A is also third coupling mechanism 30, which is positioned generally parallel to push broom bristles 18B.

Upright broom 16 can be releasably secured to lower portion 14 when third coupling mechanism 30 is releasably secured to either receiver 22 or 22 '. In the depicted embodiments, post 32 on upright broom 16 is inserted or nested into the open end of receiver 22. Where buttons 38 and 38' are utilized they are squeezed to allow stoppers 36 and 36' to enter into receiver 22. When post 32 is appropriately positioned, buttons 38 and 38' are released and the flexibly resilient support arms bias stoppers 36 and 36' into corresponding holes 26. As shown in FIGS. 3 to 6, upright broom 16 is thereby secured in place and the longitudinal axis of upright broom bristles 16B is generally aligned with the longitudinal axis of handle 11. For removal, buttons 38 and 38' can be depressed to allow withdrawal of post 32 from receiver 22.

As will be appreciated, since the posts and receivers are octagonal prism shaped in the present embodiment, upright broom 16 can be positioned and locked into four discrete angular arrangements relative to lower portion 14. It will also be appreciated that a wide variety of other geometric shapes can be utilized for post 32 and receivers 22 and 22'. It will also be appreciated that holes 26 and 26' need not necessarily be formed in each of side walls 24 and 24'.

Push broom 18 can be releasably secured to lower portion 14 in a similar fashion, when third coupling mechanism 30 is releasably secured to either receiver 22 or 22'. In the depicted embodiments, post 32 on push broom 18 is inserted or nested into the open end of receiver 22' using the same process as described above. The longitudinal axis of push broom bristles 18B may be arranged at an angle relative to the longitudinal axis of handle 11. It will be appreciated that since second coupling mechanism 28 consists of more than one receiver 22', post 32 on push broom 18 can be inserted into any individual receiver 22' the user desires in order to position push broom 18 at varying locations along the length of lower portion 14.

As noted earlier, since post 32 on push broom 18 and receiver 22' are octagonal prism shaped in the present embodiment, push broom 18 can be positioned and locked into four discrete angular arrangements relative to lower portion 14, as generally depicted in the drawings.

Figure 8:
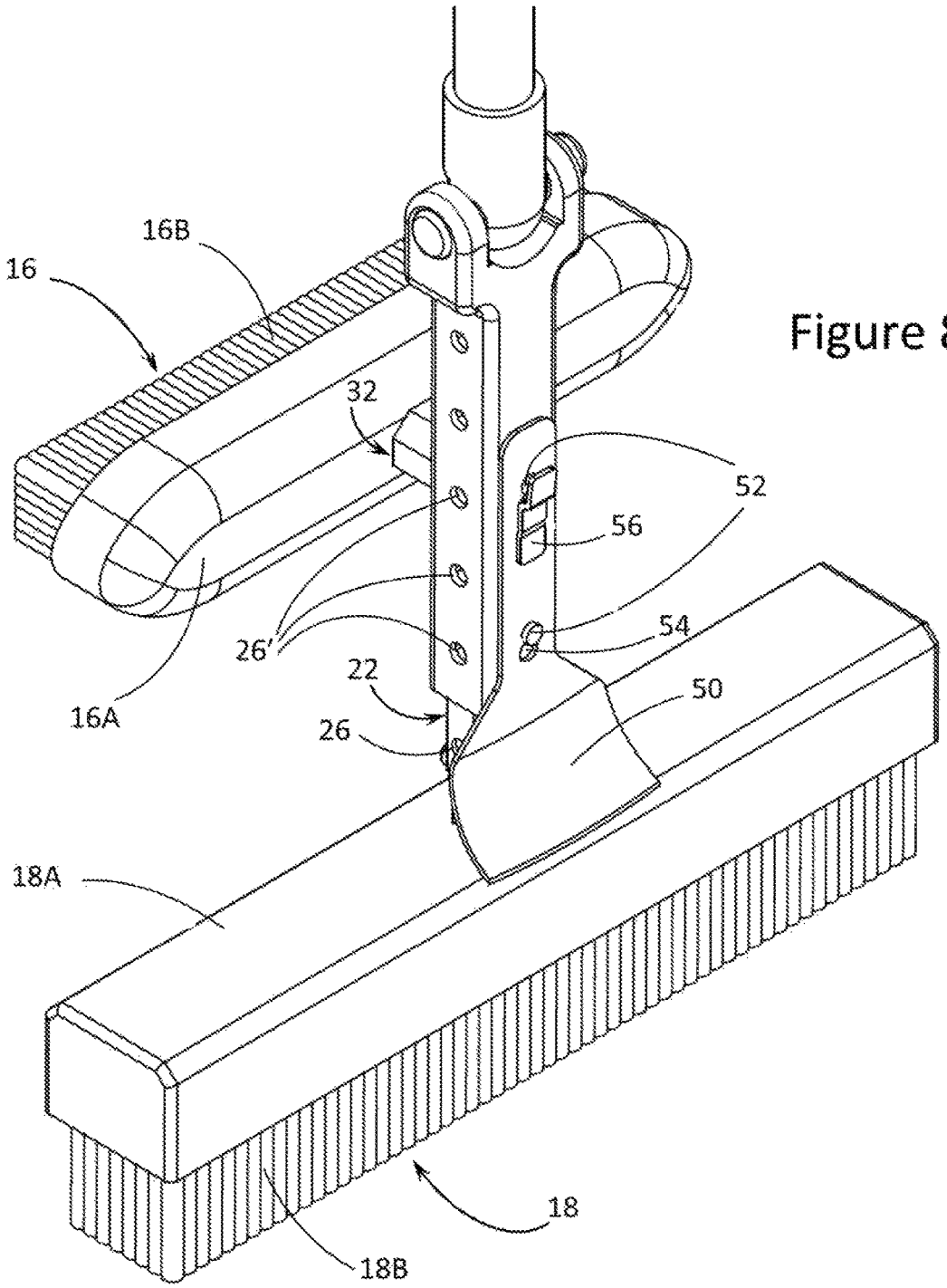
FIG. 8 is a perspective view of the lower end of an alternative configuration of the cleaning tool, wherein the upright broom and push broom positions are reversed.

Given that the third coupling mechanisms on upright broom 16 and push broom 18 are substantially similar and can fit into either first coupling mechanism 20 or second coupling mechanism 28, upright broom 16 and push broom 18 are interchangeable and replaceable on lower portion 14. As shown in FIG. 8, the broom heads may be switched in that upright broom 16 is releasably securable to lower portion 14 via second coupling mechanism 28 and push broom 18 is releasably securable to lower portion 14 via first coupling mechanism 20.

A further embodiment of the invention is shown in FIGS. 9-14, which illustrate a variation on the coupling mechanism. In this embodiment, post 32 of third coupling mechanism 30 includes spring tabs 62 that are biased outwardly. Spring tabs 62 engage ledges 64 of receivers 22 and 22' when post 32 is inserted into the respective receiver, to releasably secure the cleaning device within the receiver. In order to release the cleaning device, spring tabs 62 are forced inwardly such that they disengage ledges 64, after which post 32 can be withdrawn from its receiver.

It will be appreciated that the first, second and third coupling mechanisms are not limited to the mechanisms described herein. Their positions may be switched or reversed where the receiver is fixed to the cleaning device and the post is fixed to the lower portion of the cleaning tool. The mechanisms may also instead be comprised of receivers and parts of a different polygonal prism shape, a washer and wing-nut combination, a simple friction connection, or other common means used to releasably secure components together.

Upper portion 12 and lower portion 14 of handle 11 are pivotally connected by hinge 40 and securable to each other in a number of fixed angular arrangements. Hinge 40 can be any commonly known hinge mechanism used to secure components together. Hinge 40 may include a releasable locking mechanism (not shown) which allows lower portion 14 to be releasably "locked" into discrete angular configurations relative to upper portion 12.

FIGS. 3 to 6 show cleaning tool 10 wherein hinge 40 is in an angular configuration allowing for the user to use upright broom 16. FIGS. 1 and 2 show cleaning tool 10 wherein hinge 40 is in a second angular configuration allowing for the user to use push broom 18.

Figure 11:
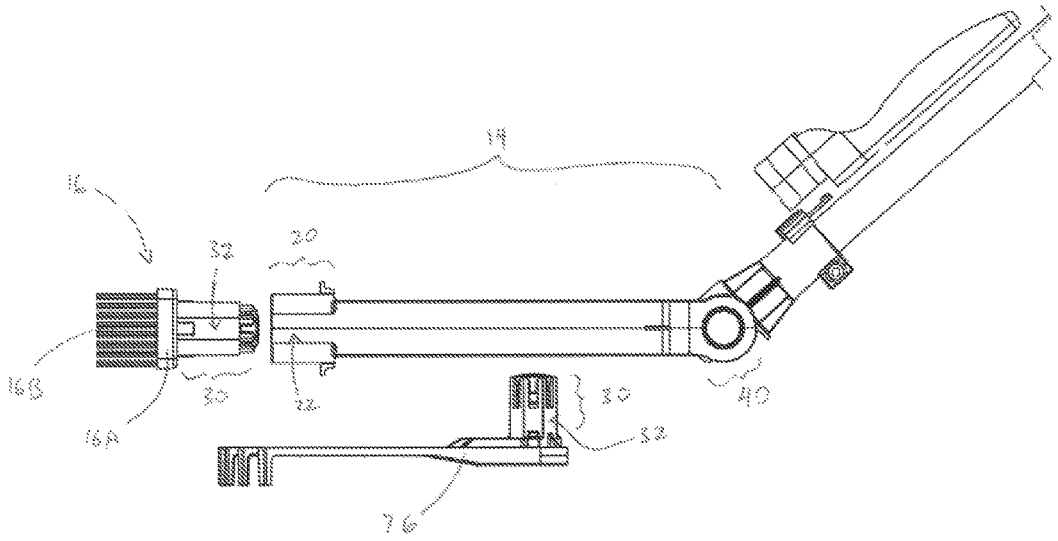
FIG. 11 is a partial side exploded view of an alternative configuration of the cleaning tool of FIG. 9, wherein the push broom has been replaced with a fan rake and the scrapper has been removed.
Figure 12:
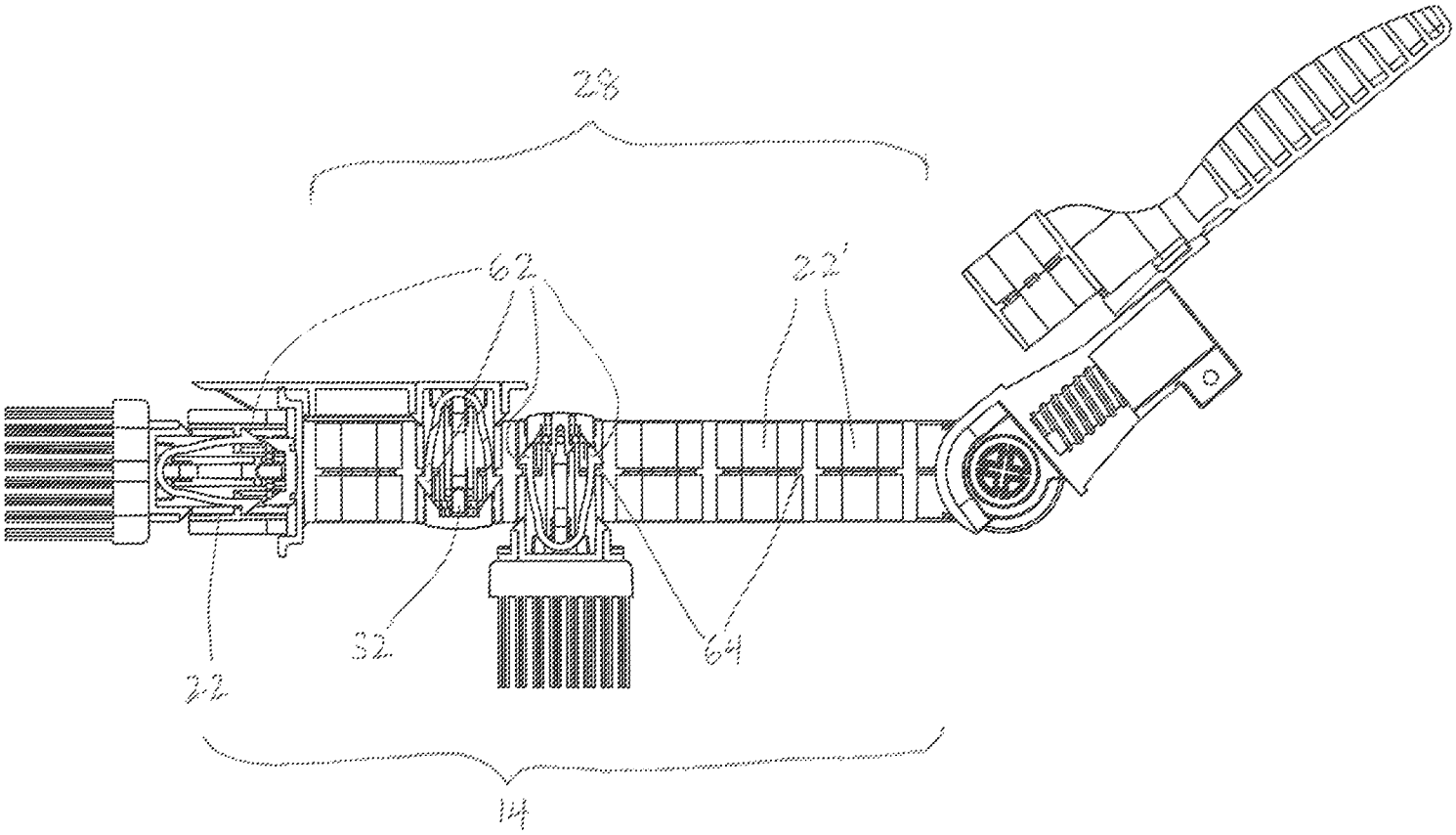
FIG. 12 is a side section view along B-B of FIG. 10.
Figure 13:
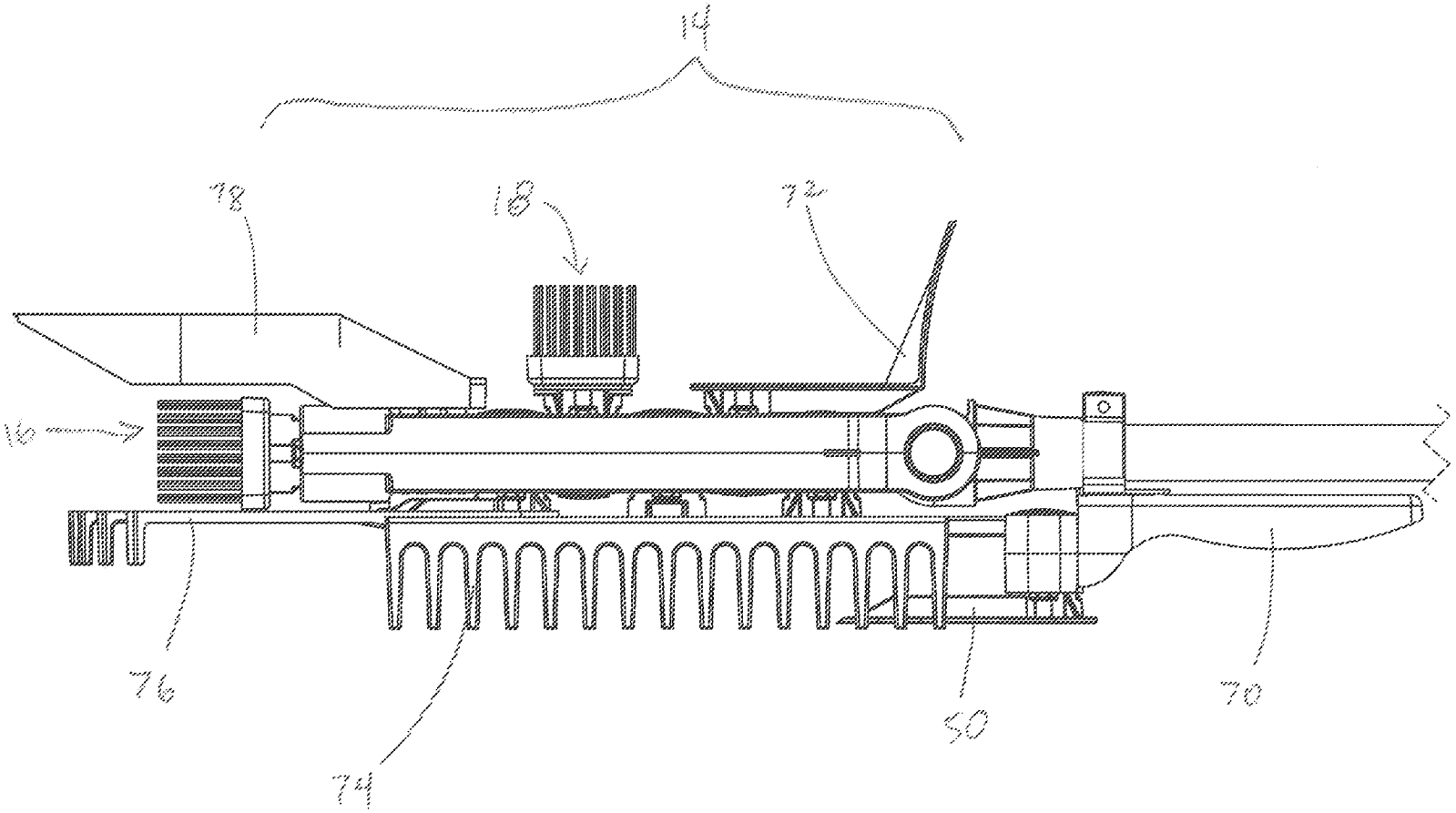
FIG. 13 is a side view of the cleaning tool of FIG. 9 according an alternative configuration, wherein multiple cleaning devices are simultaneously attached to the cleaning tool.

Optional alternative cleaning devices or accessories can be used in place of upright broom 16 or push broom 18 on lower portion 14 of handle 11. Such optional cleaning devices are interchangeable, replaceable, and include, but are not limited to, a squeegee 72, a flat rake 74, a fan rake 76, and/or a shovel 78. Fixed to, or integral with, each of the optional cleaning devices is third coupling mechanism 30, which can be releasably secured to the first or second coupling mechanism of the lower portion 14 in a similar fashion as described above. FIG. 11, for example, depicts fan rake 76 that may be fixed to lower portion 14 with a third coupling mechanism 30.

Receivers 22' of second coupling mechanism 28 may completely extend laterally through lower portion 14 such that post 32 can be inserted into receivers 22' from either side of lower portion 14. In this way, cleaning devices can be releasably secured to either side of lower portion 14. In the case of the embodiment shown in FIG. 13, multiple cleaning devices can be simultaneously attached to both sides of lower portion 14.

Tool 10 can also include a scraper 50. Scrapper 50 can be releasably attached to lower portion 14 of handle 11 and used in conjunction with handle 11, or can be removed and used separately on its own. As shown in FIGS. 7 and 8, scraper 50 can be releasably secured to lower portion 14 of handle 11 via two posts 52 with enlarged heads fixed to lower portion 14. Scraper 50 has two key-shaped openings 54 specifically placed to allow seating of posts 52 through key-shaped openings 54. Scraper 50 also has a flexibly resilient retainer 56 associated with the key-shaped opening (not shown) furthest from the scraper's head.

Scraper 50 is releasably secured to lower portion 14 by seating posts 52 through key-shaped openings 54 and shifting or sliding scraper 50 along the axis of lower portion 14 such that the post under retainer 56 forces the retainer to flex or bend upwardly, thereby exerting a biasing force on the post and holding scraper 50 in place on lower portion 14.

Figure 9:
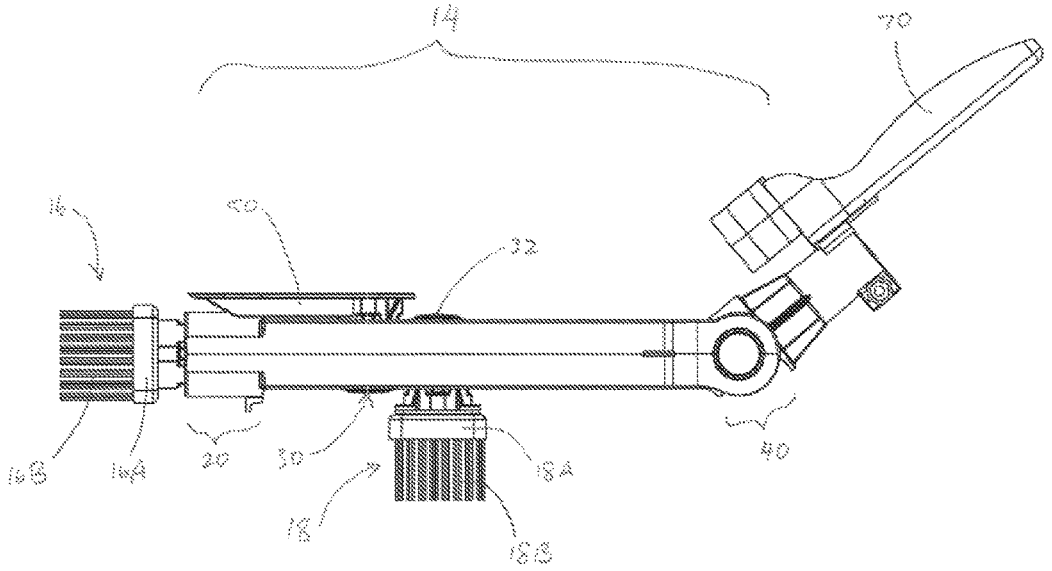
FIG. 9 is a side view of the lower end of the cleaning tool according to another example embodiment of the present invention, wherein a hand tool, a scrapper, a push broom and a upright broom are included.
Figure 10:
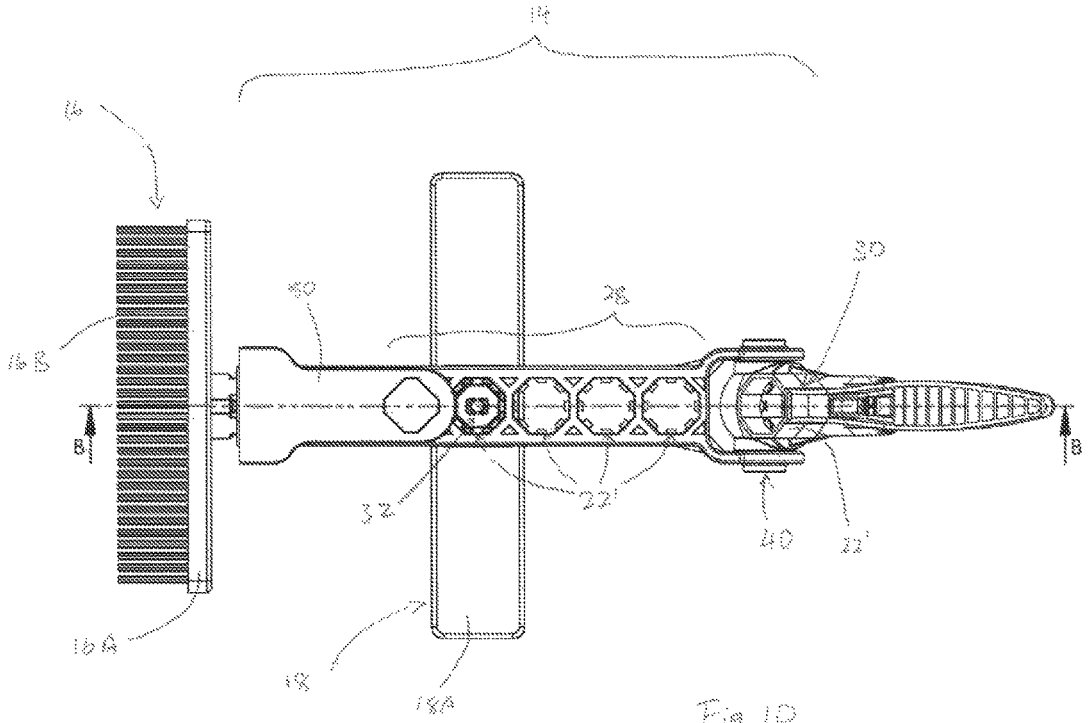
FIG. 10 is a top view of the cleaning tool of FIG. 9.

Alternatively, as shown in FIGS. 9 and 10, scrapper 50 may include a third coupling mechanism 30, which can be releasably secured to the first or second coupling mechanism of the lower portion 14 in a similar fashion as described above.

Figure 14:
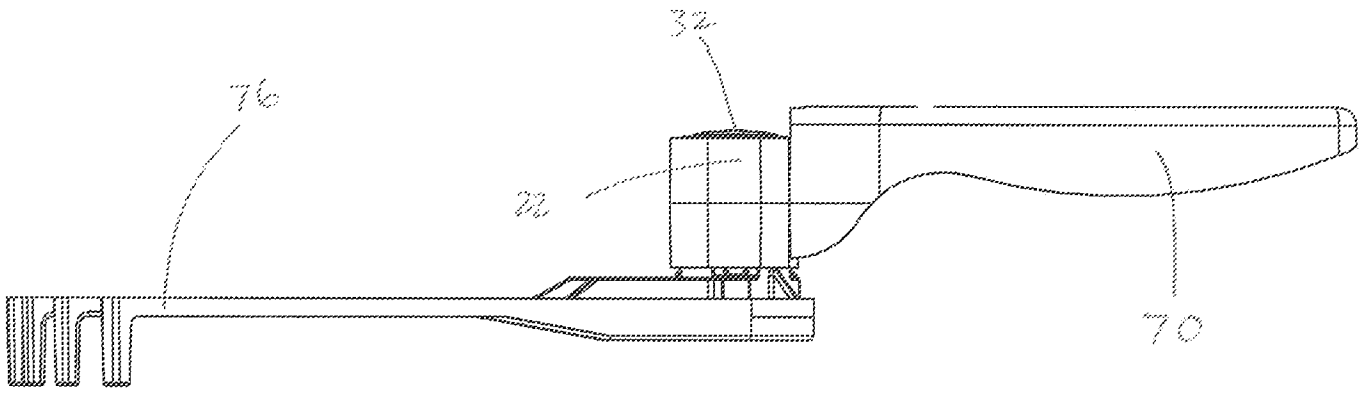
FIG. 14 is a side view the hand tool of FIG. 9 in combination with the fan rake of FIG. 11.

The embodiment of FIGS. 9-14 further includes a hand tool 70. Hand tool 70 is releasably securable to upper portion 12 and can be used independently of handle 11. It will be appreciated that a wide variety of mechanisms to releasably secure hand tool 70 to upper portion 12 could be utilized. One end of hand tool 70 includes a receiver 22' which is configured to receive third coupling mechanism 30, or specifically a post 32, attached to a cleaning device. When hand tool 70 is released from handle 11 and post 32 of a cleaning device is releasably secured within receiver 22', the cleaning device can be used independently of handle 11. For example, FIG. 14 shows a fan rake 76 secured to hand tool 70, permitting the rake to be used independently from handle 11. In a like manner, any one of the cleaning devices could be used in a single-handed fashion in combination with hand tool 70, if desired.

It is to be understood that what has been described are example embodiments of the invention. The scope of the claims should not be limited by the embodiments set forth above, but should be given the broadest interpretation consistent with the description as a whole.

The invention claimed is:

1. A cleaning tool comprising:

handle having a longitudinal axis; and a cleaning device having a longitudinal axis;

said cleaning device releasably securable to said handle and moveable between a first position where the longitudinal axis of said cleaning device is generally aligned with the longitudinal axis of said handle, and a second position where the longitudinal axis of the cleaning device is arranged at an angle relative to the longitudinal axis of said handle;

wherein said cleaning tool has first, second and third coupling mechanisms, said first and second coupling mechanisms offset by 90 degrees to each other and fixed to or integral with said handle, said third coupling mechanism fixed to or integral with said cleaning device and releasably and independently securable to said first and said second coupling mechanisms to releasably secure said cleaning device to said handle, wherein when said third coupling mechanism is releasably secured to said first coupling mechanism, said cleaning device is positioned such that its longitudinal axis is generally aligned with the longitudinal axis of said handle, wherein when said third coupling mechanism is releasably secured to said second coupling mechanism, said cleaning device is positioned such that its longitudinal axis is at an angle relative to the longitudinal axis of said handle; and wherein said handle includes a lower portion and an upper portion, said lower portion pivotably connected to said upper portion, said lower portion including said first and second coupling mechanisms and having said longitudinal axis of said handle.

2. The cleaning tool of claim 1 wherein said upper and said lower portions of said handle are releasably securable to each other in a plurality of fixed angular relationships.

3. The cleaning tool of claim 2 including a hand tool releasably securable to said handle, said hand tool releasably securable to said cleaning device facilitating use of said cleaning device independently of said handle.

4. The cleaning tool as claimed in claim 1 wherein said cleaning device is a broom head having bristles extending therefrom, said bristles having a longitudinal axis arranged in a generally parallel relationship to the longitudinal axis of said handle when said third coupling mechanism is releasably secured to said first coupling mechanism, and said bristles being at an angle to the longitudinal axis of said handle when said third coupling mechanism is releasably secured to said second coupling mechanism.

5. The cleaning tool of claim 1 including a hand tool releasably securable to said handle, said hand tool releasably securable to said cleaning device facilitating use of said cleaning device independently of said handle.

6. The cleaning tool as claimed in claim 1 wherein said cleaning device comprises a broom head having a body with a front and a rear face, and having bristles extending from said front face, said third coupling mechanism operatively associated with said rear face.

7. The cleaning tool as claimed in claim 1 wherein one of said second and said third coupling mechanisms comprises a post and the other comprises a receiver, said post releasably securable within said receiver to releasably secure said cleaning tool to said handle.

8. The cleaning tool as claimed in claim 7 wherein said post is multi-sided and said receiver is of a similar configuration such that said post is securable within said receiver at a plurality of discrete angular arrangements.

9. The cleaning device as claimed in claim 8 wherein said post includes one or more spring tabs that engage ledges within said receiver to releasably secure said post within said receiver.

10. The cleaning tool of claim 8 wherein said cleaning device is a first cleaning device, and further comprising a second cleaning device, one of the first and second cleaning devices being releasably secured to said first coupling mechanism and the other of the first and second cleaning devices being releasably secured to said second coupling mechanism.

11. The cleaning tool as claimed in claim 8 wherein said cleaning device secured to said first coupling mechanism comprises a broom head, squeegee, mop head, rake, or plow member.

12. The cleaning tool as claimed in claim 1 wherein said cleaning device is a broom head having bristles that are arranged at an angle of 90 degrees to the longitudinal axis of said handle when said broom head is in said second arrangement.

13. A cleaning tool comprising:

an elongate handle including an upper portion pivotally connected to a lower portion, said lower portion having a longitudinal axis and including first and second coupling mechanisms;

a first cleaning device comprising a first broom head having bristles extending therefrom, said bristles having a longitudinal axis and arranged in a generally parallel configuration; and a second cleaning device;

said first coupling mechanism operable to releasably secure said first broom head to said lower portion of said handle in a first arrangement in which the longitudinal axis of said bristles is generally aligned with the longitudinal axis of said lower portion of said handle;

said second coupling mechanism operable to releasably secure said second cleaning device to said lower portion of said handle;

wherein said second cleaning device is a second broom head having bristles with a longitudinal axis and arranged in a configuration such that the longitudinal axis of the bristles of the second broom head is at an angle relative to the longitudinal axis of said lower portion of said elongate handle when said second broom head is releasably secured to said lower portion of said elongate handle by said second coupling mechanism; and wherein said bristles of said second broom head are positioned at 90 degrees to the longitudinal axis of said lower portion of said elongate handle when said second broom head is releasably secured thereto.

14. The cleaning tool as claimed in claim 13 wherein said second cleaning device is a squeegee, a rake, a mop head, or a plow member.

15. The cleaning tool as claimed in claim 13 including a hand tool releasably secured to said elongate handle, said hand tool, when detached from said handle, releasably securable to said first or second cleaning devices to facilitate use of said cleaning devices independently of said handle.

* * * * *